US006582250B2

(12) United States Patent
Taylor et al.

(10) Patent No.: US 6,582,250 B2
(45) Date of Patent: Jun. 24, 2003

(54) CONNECTOR MODULE ORGANIZER

(75) Inventors: Attalee S. Taylor, Palmyra, PA (US); Randall R. Henry, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/989,268

(22) Filed: Nov. 20, 2001

(65) Prior Publication Data

US 2003/0096531 A1 May 22, 2003

(51) Int. Cl.[7] ..... H01R 13/60; H01R 13/62
(52) U.S. Cl. ..... 439/540.1; 439/371
(58) Field of Search ..... 439/540.1, 79, 439/701, 541.5, 371

(56) References Cited

U.S. PATENT DOCUMENTS 4,550,959 A * 11/1985 Grabbe et al. ..... 439/717
4,952,172 A 8/1990 Barkus et al. ..... 439/79
5,104,331 A * 4/1992 Goble ..... 439/341
5,378,166 A * 1/1995 Gallagher, Sr. ..... 439/540
5,610,472 A * 3/1997 Schmitt, Jr. ..... 439/280
6,292,986 B1 * 9/2001 Provan et al. ..... 24/415

* cited by examiner

*Primary Examiner*—P. Austin Bradley
*Assistant Examiner*—Briggitte Hammond

(57) ABSTRACT

A connector module pack is provided organizing and retaining multiple connector modules side by side in a predetermined arrangement. The connector modules are first organized into a desired arrangement with respect to each other. The connector modules may be mounted on a template to temporarily retain them in the desired arrangement. Once the modules are in the desired arrangement, an adhesive medium is applied to at least one side of each connector module. The adhesive medium retains the connector modules within the connector module pack. The adhesive medium may be one or more tape strips.

24 Claims, 15 Drawing Sheets

CONNECTOR MODULE ORGANIZER

BACKGROUND OF THE INVENTION

Certain embodiments of the present invention generally relate to connector module packs and, more particularly, to methods and apparatus for organizing and retaining groups of connector modules in predetermined orders and alignments.

Connector modules have been developed that are manually installed onto printed circuit boards and other structures. Often, a large number of connector modules, such as up to twenty connector modules, are installed on a single printed circuit board. Installation of a connector module can involve inserting hundreds of pins located on the connector module into corresponding pin receiving holes in a printed circuit board or other structure. There are several different types and sizes of connector modules that are mountable on a printed circuit board. Customers often want custom arrangements of connector modules for installation onto printed circuit boards. In order to attain a desired custom arrangement of modules on a printed circuit board, a customer may manually install the different desired modules one by one onto the printed circuit boards which can be very time consuming.

U.S. Pat. No. 4,952,172 describes an electrical connector stiffener device for use with electrical connector modules. The stiffener device is a rigid L-shaped piece of extruded metal. The stiffener device has a groove in which connector modules are slidingly received. The stiffener device also has locking clips, which are frictionally received in a channel of the stiffener device, for attaching to the connector modules and preventing relative movement between the stiffener device and the connector modules. The stiffener device provides structural support for the connector modules as well as a means for positioning the connector modules in a desired pattern.

However, there are at least two known problems with stiffener devices. The first problem is that a specific type of stiffener device must be created for each different custom arrangement of modules, or, alternatively, a bulkier and more expensive universal stiffener must be used. The locking clips are positioned along the stiffener device in an orientation specific for attaching to different sized modules in a specifically desired order. Each different custom arrangement of modules requires locking clips at different intervals along the stiffener device.

A second problem with stiffener devices is that if, after installation of the connector module pack onto a printed circuit board, one module becomes defective, replacement of that defective module is difficult. The modules are loaded onto the stiffener device from one of the ends and slid down the stiffener device to final resting positions. The modules can only be removed from the stiffener device at one the ends. Thus, instead of removing and replacing just the defective module, the entire assembly of the stiffener device and the attached connector modules must be removed from the printed circuit board. After removal from the printed circuit board, the defective module as well as every other module on one of its sides must be slid off the stiffener device. A replacement for the defective module can then be slid onto the stiffener device. After replacing the defective module, the other non-defective modules must also be slid back onto the stiffener device. Finally the stiffener device with the attached modules can be reinstalled onto the printed circuit board.

A need remains for an improved connector module organizer.

BRIEF SUMMARY OF THE INVENTION

An embodiment of the present invention provides a method of organizing, stiffening, and retaining connector modules in a connector module pack, which includes a predetermined arrangement of connector modules retained in the predetermined arrangement by an adhesive medium adhered to walls of the connector modules. The connector modules are aligned side by side and may be in direct contact with each other. Optionally, there may be a gap between any of the adjacent modules. Each module may have the same width, height, and depth as every other module, but need not. Adjacent modules may have walls aligned in common planes, but need not. The adhesive medium may be one or more tape strips attached to at least one of top, side, and back walls of each module. The tape strips can be attached to exposed top, side, and back walls of the modules in a general longitudinal direction with respect to the connector module pack so that the tape strips overlap two or more of the modules. Optionally, double-sided tape strips can be attached to unexposed abutting side walls of the connector modules so that one or more tape strips is located between any two modules.

An advantage of certain embodiments of the present invention is that connector modules can be organized, retained, and stiffened in connector module packs of varying pre-configured arrangements. Thus, connector module packs for varying customer applications can be manufactured for customers ready to install.

A second advantage of certain embodiments of the present invention is that if a module becomes defective after installation of the connector module pack onto the printed circuit board, the defective module can be removed from the printed circuit board without disturbing any of the other modules. The customer can cut the tape that holds the defective module to adjacent modules within the connector module pack, thereby freeing the defective module from the rest of the connector module pack. Once the defective module is freed, the defective module can be removed and replaced.

Another advantage of certain embodiments of the present invention is that once a connector module pack is installed onto a printed circuit board, the tape can be removed for enhanced heat dissipation during use. Alternatively, the tape could be metalized and remain on the connector module pack during use to shield electromagnetic interference.

These and other features and embodiments of the present invention are discussed or apparent in the following detailed description of embodiments of the invention.

The foregoing summary, as well as the following detailed description of certain embodiments of the present invention, will be better understood when read in conjunction with the appended drawings. It should be understood, however, that the present invention is not limited to the arrangements and instrumentality shown in the attached drawings.

DETAILED DESCRIPTION OF THE INVENTION

Figure 1:
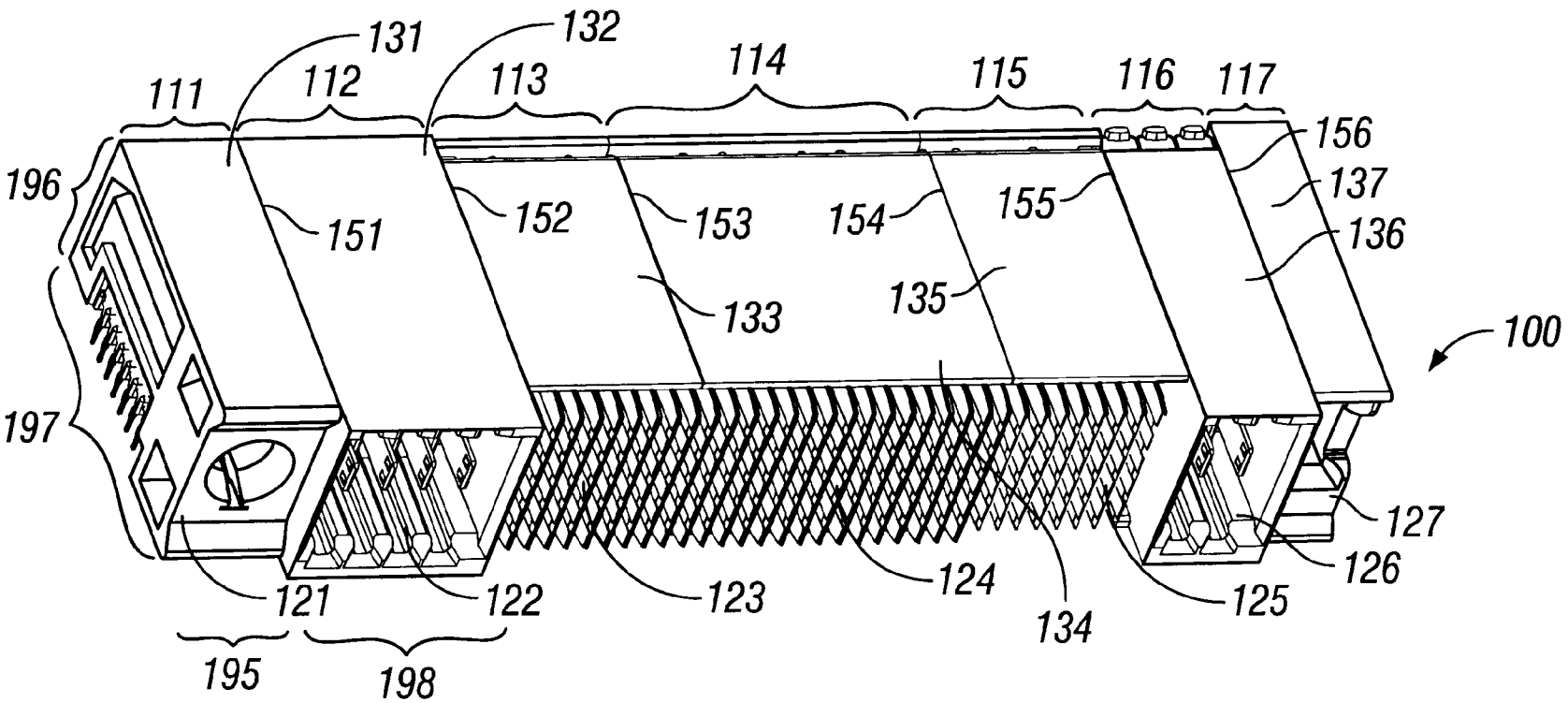
FIG. 1 illustrates a perspective view of a connector module pack used in accordance with an embodiment of the present invention.

FIG. 1 illustrates a connector module pack 100 used in connection with an embodiment of the present invention. The connector module pack 100 includes a plurality of connector modules 111–117 that are, by way of example only, generally of rectangular block shape. The connector modules 111–117 are located adjacent to, and in direct contact with one another, at interfaces 151–156 in an order determined by an application in which the connector modules 111–117 are to be used. In the example of FIG. 1, the connector modules 111–117 are right angle connector modules, having front connecting surfaces 121–127 and bottom connecting surfaces 161–167 (see FIG. 2) formed at a right angle to one another. The connector modules 111–117 include guide connector modules 111, 117, power connector modules 112, 116, and signal connector modules 113–115. Connector module 111 includes a width 195, height 196, and depth 197. Connector module 112 includes a width 198 that is different than the width 195 of the connector module 111. The connector modules 111–117 include top surfaces 131–137 that are aligned coplanar with one another.

Figure 2:
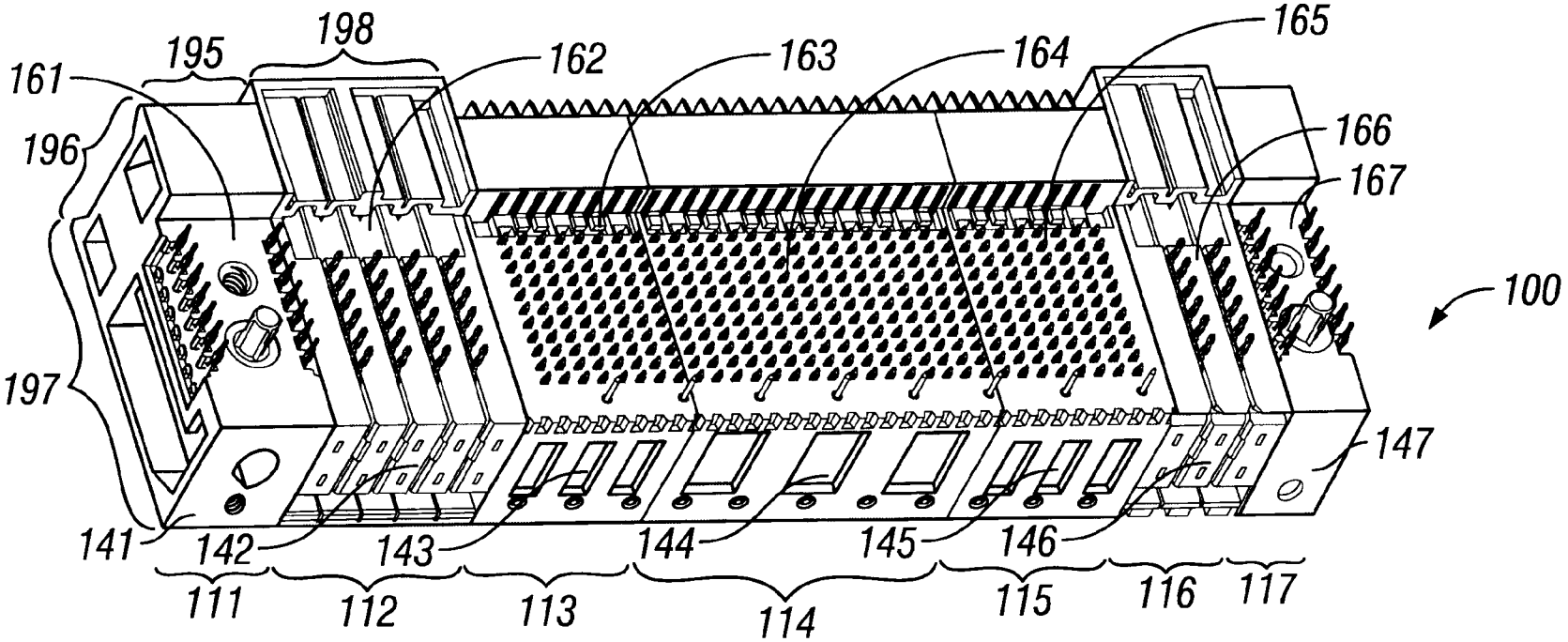
FIG. 2 illustrates an inverted perspective view of the connector module pack of FIG. 1.

FIG. 2 illustrates the bottom of the connector module pack 100. The connector modules 111–117 include back surfaces 141–147 that are also coplanar with one another. The bottom surfaces 161–167 include signal and ground pins projecting downward therefrom.

Figure 3:
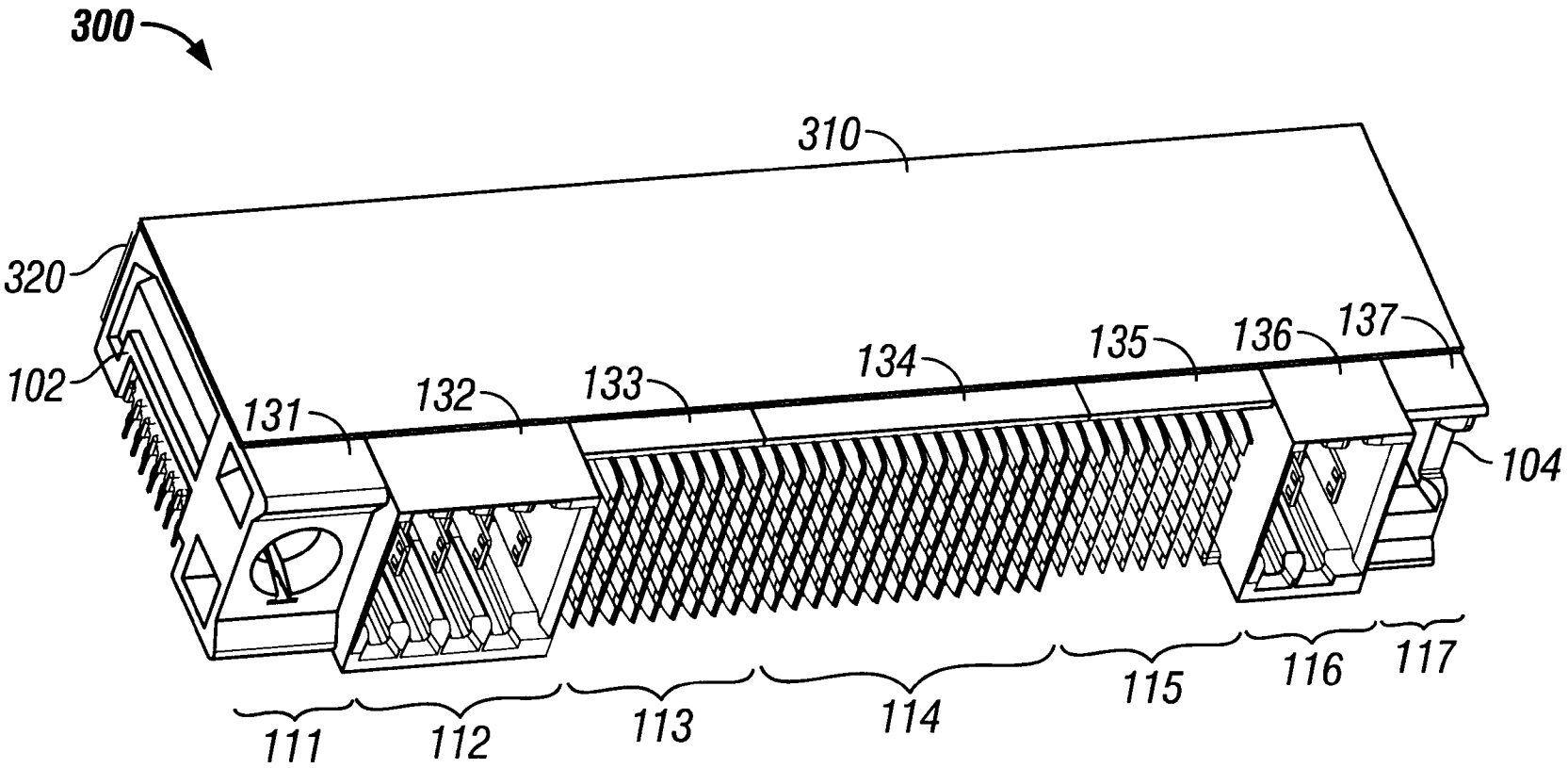
FIG. 3 illustrates a top front perspective view of a connector module pack joined with an adhesive medium in accordance with an embodiment of the present invention.
Figure 4:
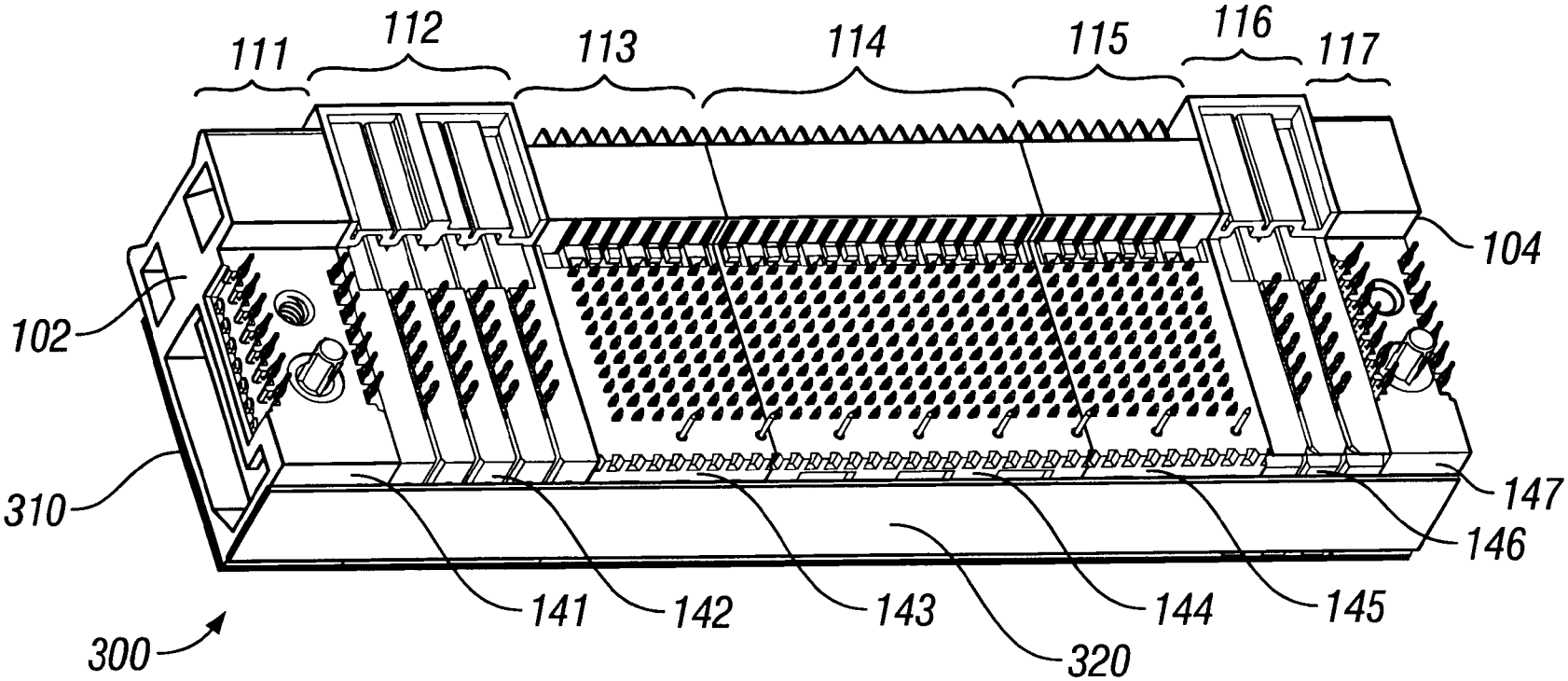
FIG. 4 illustrates a bottom rear perspective view of the connector module pack and adhesive medium of FIG. 3.
Figure 5:
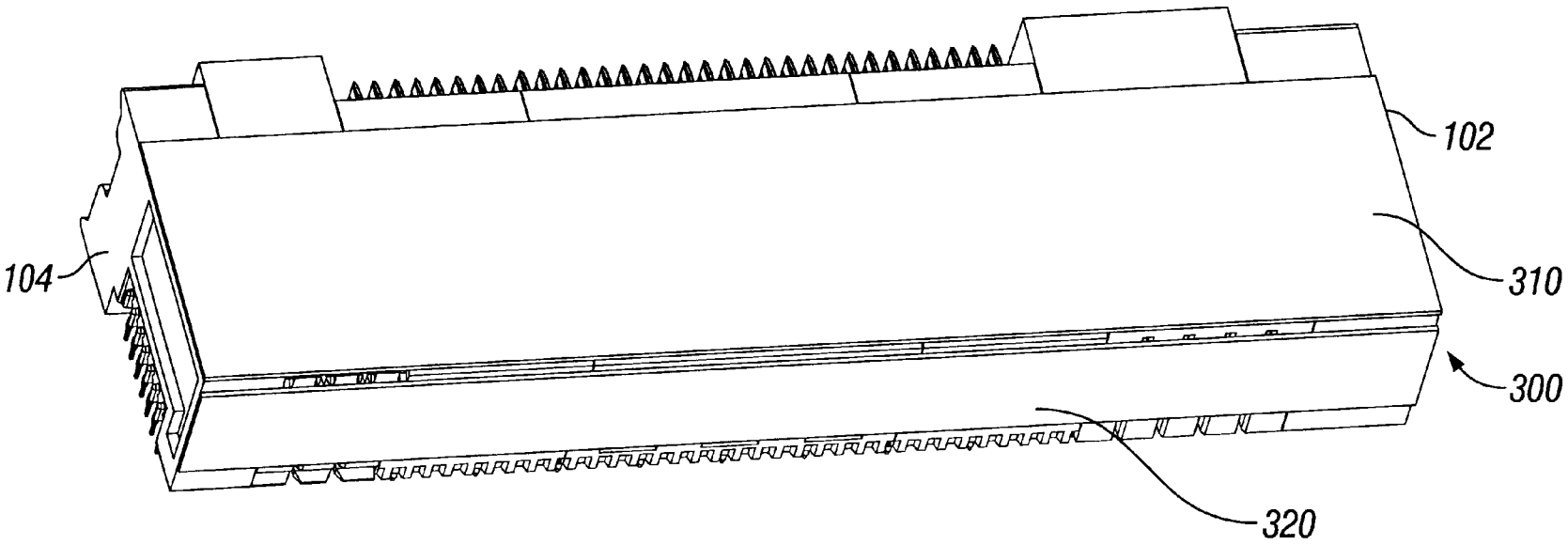
FIG. 5 illustrates a top rear perspective view of the connector module pack and adhesive medium of FIG. 3.

FIG. 3 illustrates the connector module pack 100 joined with an adhesive medium 300 in accordance with an embodiment of the present invention. The adhesive medium 300 includes top and back adhesive tape strips 310, 320. The top adhesive tape strip 310 is adhered to the top surfaces 131–137 of the connector modules 111–117. As shown in FIGS. 4 and 5, back adhesive tape strip 320 is adhered to the back surfaces 141–147 of the connector modules 111–117. The top adhesive tape strip 310 and the back adhesive tape strip 320 cooperate to retain the connector modules 111–117 within the connector module pack 100 with the connector modules 111–117 located adjacent to, and in direct contact with, one another at interfaces 151–156. The adhesive tape strips 310, 320 also give structural support to the connector module pack.

In the example of FIGS. 3–5, the adhesive medium 300 extends along an entire length of the connector module pack 100 between ends 102 and 104. Optionally, the adhesive medium 300 need not extend from end 102 to end 104, but instead may only partially cover outer connector modules 111 and 117 (see FIG. 10). Alternatively, the top and/or back adhesive tape strips 310 and 320 may be separated into multiple individual staggered tape strips aligned side-by-side that each overlap two or more of the connector modules 111–117 (see. FIG. 11). Additionally, the adhesive medium 300 could be removed from the connector module pack 100 after the connector module pack 100 is installed on a printed circuit board to enhance heat dissipation during use. Alternatively, the adhesive medium 300 could constitute metalized tape and remain on the connector module pack 100 after installation to afford shielding from electromagnetic interference during use. If metalized tape was used, it would be electrically grounded.

Figure 6:
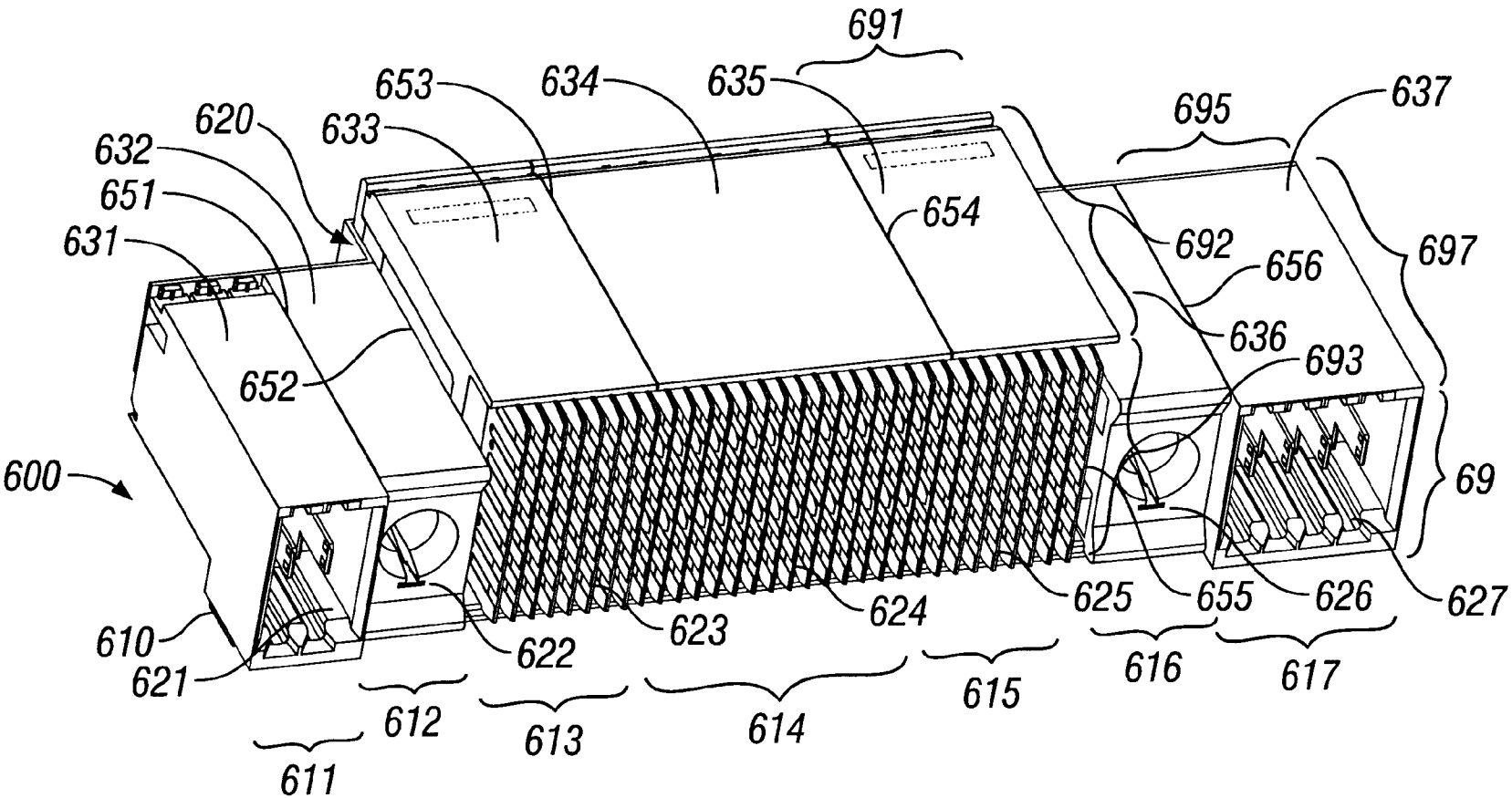
FIG. 6 illustrates a top front perspective view of a connector module pack and adhesive medium formed in accordance with an alternative embodiment of the present invention.
Figure 7:
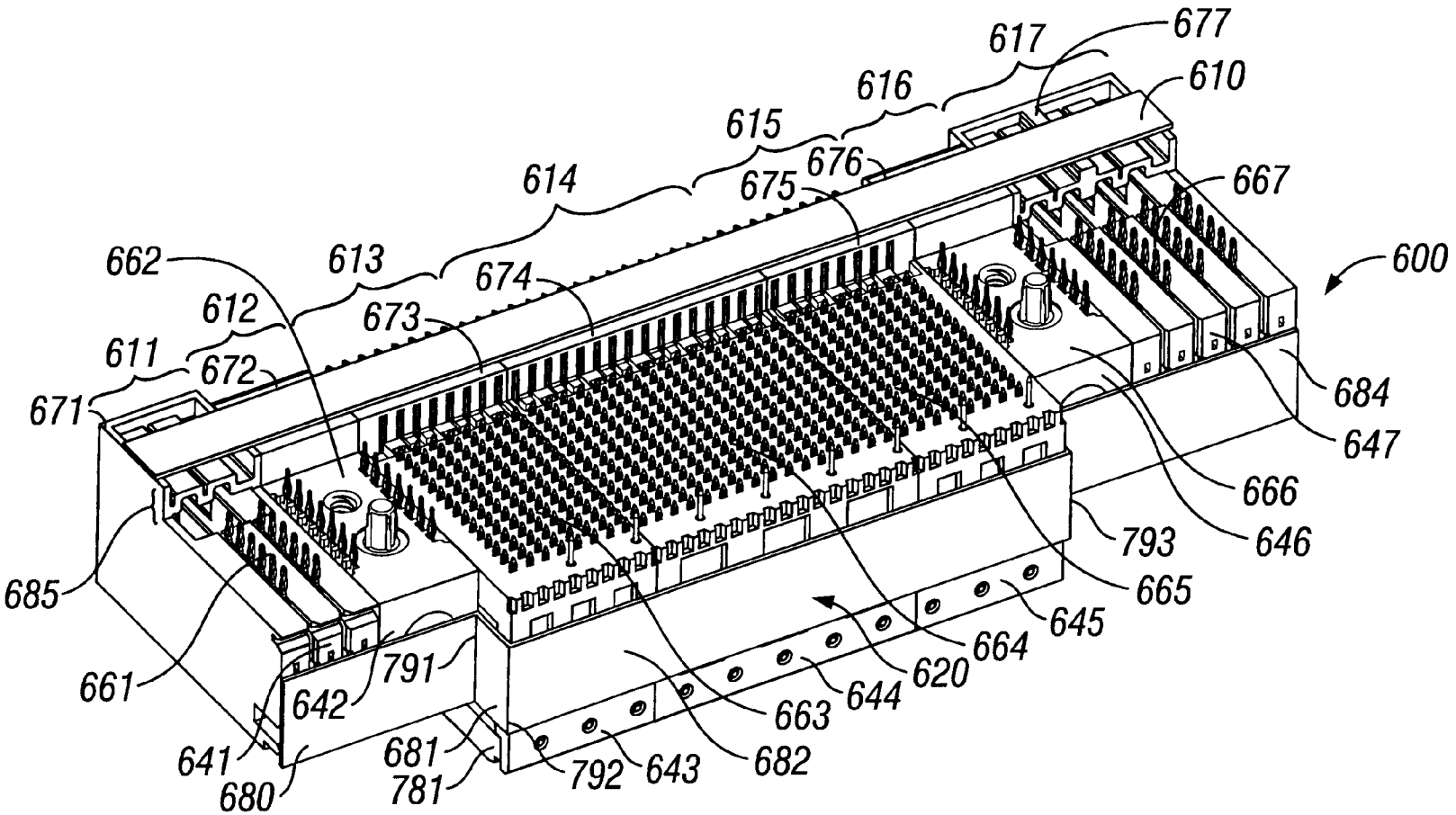
FIG. 7 illustrates a bottom rear perspective view of the connector module pack and adhesive medium of FIG. 6.

FIGS. 6 and 7 illustrate a connector module pack 600 formed in accordance with an alternative embodiment of the present invention. The connector module pack 600 includes a plurality of connector modules 611–617 that are, by way of example only, generally of rectangular block shape. The connector modules 611–617 are located adjacent to, and in direct contact with, one another at interfaces 651–656. The connector modules 611–617 are arranged in an order dependent upon an application for which the connector module pack 600 is intended. The connector modules 611–617 are right angle connector modules, including front connecting surfaces 621–627 shown in FIG. 6 and bottom connecting surfaces 661–667 shown in FIG. 7 formed at a right angle to one another. The bottom connecting surfaces 661–667 include a plurality of signal and ground pins projecting therefrom. The connector modules 611–617 include guide connector modules 612, 616, power connector modules 611, 617, and signal connector modules 613–615.

The connector modules 611–617 include top surfaces 631–637, some of which are not coplanar with one another. Top surfaces 631, 632 of connector modules 611, 612 are coplanar with respect to each other, top surfaces 633–635 of the signal connector modules 613–615 are coplanar with respect to each other, and top surfaces 636, 637 of the connector modules 616, 617 are coplanar with respect to each other. However, the top surfaces 631, 632 are not coplanar with the top surfaces 633–635, which in turn are not coplanar with the top surfaces 636, 637. More specifically, connector modules 632, 633 form a non-planar intersection at interface 652, and connector modules 635, 636 form a non-planar intersection at interface 655. The term coplanar indicates that the connector modules 611–617, whether directly touching or being separated by a gap, include surfaces aligned in a common plane. The term non-planar indicates that surfaces of two connector modules, while being aligned in a common direction (e.g. parallel or at acute angles), lie in different intersecting planes. For example, top surfaces that form a non-planar interface may lie in parallel, non-intersecting planes, or intersecting planes forming an acute angle with one another.

As shown in FIG. 7, the connector modules 611–617 include back surfaces 641–647 that are also only partially coplanar. Back surfaces 641, 642 of the connector modules 611, 612 are coplanar with respect to each other, back surfaces 643–645 of the connector modules 613–615 are coplanar with respect to each other, and back surfaces 646, 647 of the last two connector modules 616, 617 are coplanar with respect to each other. However, back surfaces 643–645 are not coplanar with back surfaces 641, 642, nor with 646, 647. The connector module 613 includes a first side surface 781 that extends rearward beyond the back surface 642. The connector module 615 includes a side surface 881 shown in FIG. 8 that extends rearward beyond the back surface 646.

Figure 8:
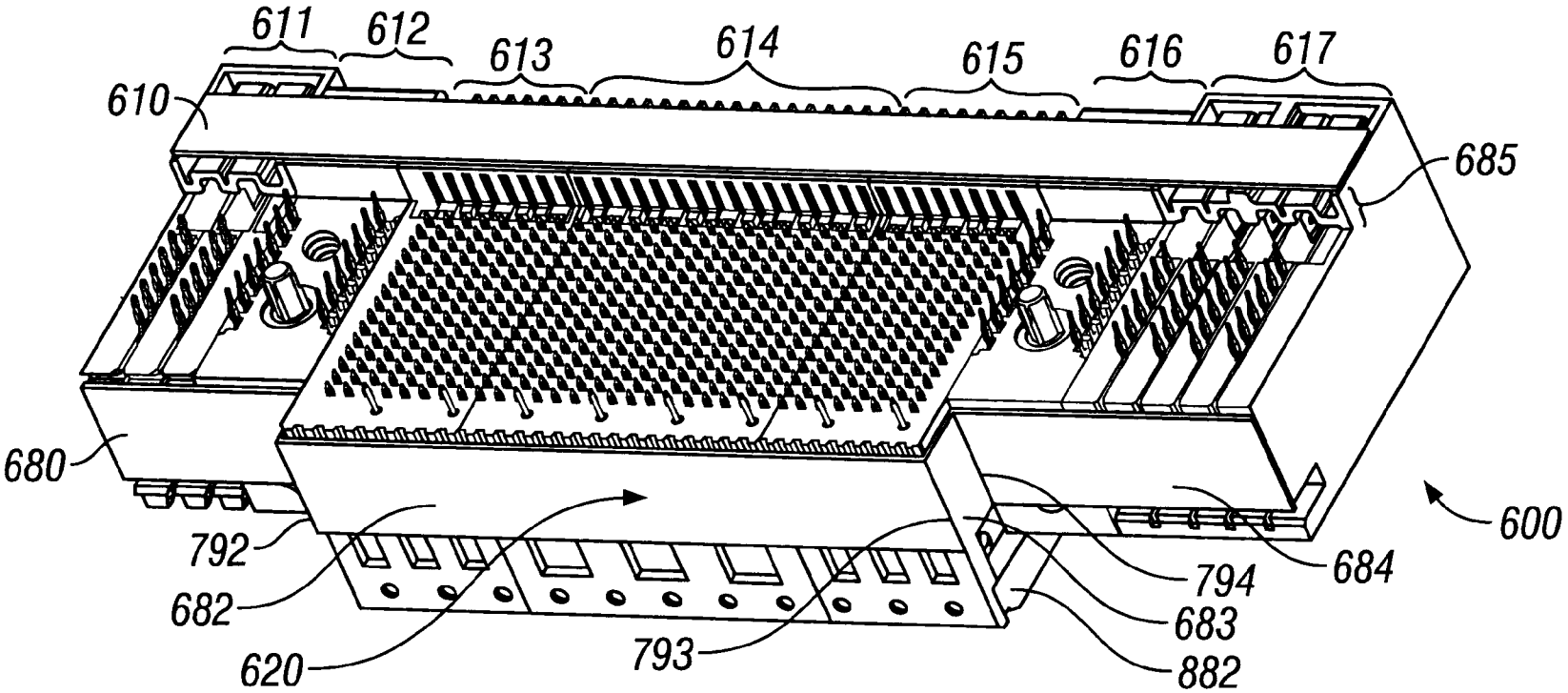
FIG. 8 illustrates a reverse bottom rear perspective view of the connector module pack and adhesive medium of FIG. 6.

As shown in FIGS. 7 and 8, a back adhesive tape strip 620 includes four right angle lines 791–794. A portion 680 of the back adhesive tape strip 620 is adhered to the coplanar back surfaces 641, 642 of the connector modules 611, 612. A portion 681 of the back adhesive tape strip 620 is adhered to the side surface 781 of the connector module 613. A portion 682 of the back adhesive tape strip 620 is adhered to the coplanar back surfaces 643–645 of the connector modules 613–615, while a portion 683 of the back adhesive tape strip 620 is adhered to the side surface 881 of the connector module 615, and a portion 684 is adhered to the coplanar back surfaces 646, 647 of the connector modules 616, 617.

The back adhesive tape strip 620 is divided either physically or only functionally into portions 680–684. In other words, the portions 680–684 may constitute separate pieces of the back adhesive tape strip 620 that meet, and adhere to one another, at seams represented by lines 791–794. Alternatively, the portions 680–684 may be integral with one another and merely bent at lines 791–794.

The connector modules 611–617 include bottom lead surfaces 671–677 that are located proximate the front connecting surfaces 621–627. The bottom lead surfaces 671–677 are located shifted downward from the bottom connecting surfaces 661–667 to form a shelf 685 therebetween that abuts against an edge of a printed circuit board on which the connector module pack 600 is mounted or other structure. The bottom lead surfaces 671–677 are coplanar in the example of FIG. 7. The bottom adhesive tape strip 610 is adhered to the coplanar bottom lead surfaces 671–677 to hold the connector modules 611–617 together.

The bottom and back adhesive tape strips 610, 620 retain the connector modules 611–617 within the connector module pack 600 so that the connector modules 611–617 remain located adjacent to, and in direct contact with, one another at interfaces 651–656 in an order determined by a particular application for which the connector module pack 600 is intended. The bottom and back adhesive tape strips 610, 620 also give structural support to the connector module pack 600.

Figure 9:
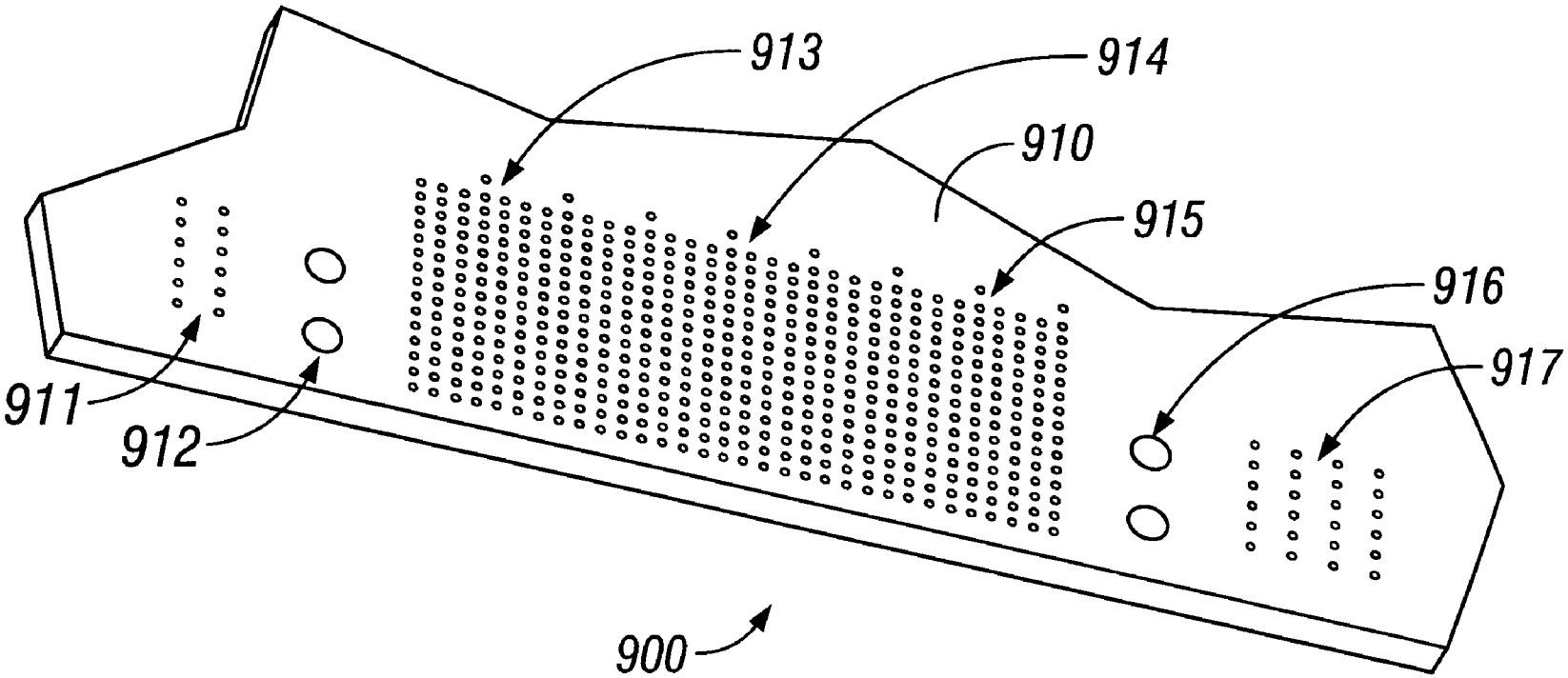
FIG. 9 illustrates a perspective view of an assembly template for mounting connector module packs formed in accordance with an embodiment of the present invention.

FIG. 9 illustrates an assembly template 900 used in accordance with an embodiment of the present invention to organize connector modules while applying an adhesive medium thereto. Assembly templates 900 are used for preconfiguring connector modules into connector module packs of desired predetermined arrangements for different customer applications. Optionally, connector modules may be arranged into predetermined arrangements by alternative methods not employing assembly templates 900. The assembly template 900 includes a mating surface 910 that includes a predetermined arrangement of holes and other cavities, protrusions, and openings that represent the mating features of a printed circuit board or other structure to which the connector module packs 100 and 600 are joined. The holes, cavities, etc., are arranged in mating configurations 911–917 for receiving pins extending from the bottom connecting surfaces 661–667 of the connector modules 611–617. The holes, cavities, etc., may be over-sized in order to receive the pins without deforming the pins. The mating configurations 911–917 are complimentary to the configurations of the pins and contacts on the corresponding bottom connecting surfaces 661–667 of the connector modules 611–617. The connector modules 611–617 of the connector module pack 600 fit, in a predetermined order, on the mating surface 910 of the assembly template 900.

During assembly of the connector module pack 600, the connector modules 611–617 are mounted onto the mating surface 910 of the assembly template 900. Each of the connector modules 611–617 is placed onto the mating surface 910 of the assembly template 900 so that pins and contacts in the bottom connecting surfaces 661–667 of the connector modules 611–617 fit in the corresponding complimentary mating configurations 911–917 of the mating surface 910. The assembly template 900 retains the connector modules 611–617 in place. Once the connector modules 611–617 are mounted in the predetermined order, the adhesive medium is applied. The bottom adhesive tape strip 610 is applied to the coplanar non-connecting bottom surfaces 671–677 of the connector modules 611–617. The back adhesive tape strip 620 is applied to the back surfaces 641, 642 of the connector modules 611, 612. The back adhesive tape strip 620 is also applied to the side surface 781 of the connector module 613, to the back surfaces 643–645 of the connector modules 613–615, to the side surface 881 of the connector module 615 and to the back surfaces 646, 647 of the modules 616, 617.

The bottom and back adhesive tape strips 610, 620 retain the connector modules 611–617 within the connector module pack 600 so that the connector modules 611–617 remain located adjacent to, and in direct contact with, one another at interfaces 651–656 in the predetermined order. The adhesive tape strips 610, 620 also give structural support to the taped connector module pack 600.

Figure 10:
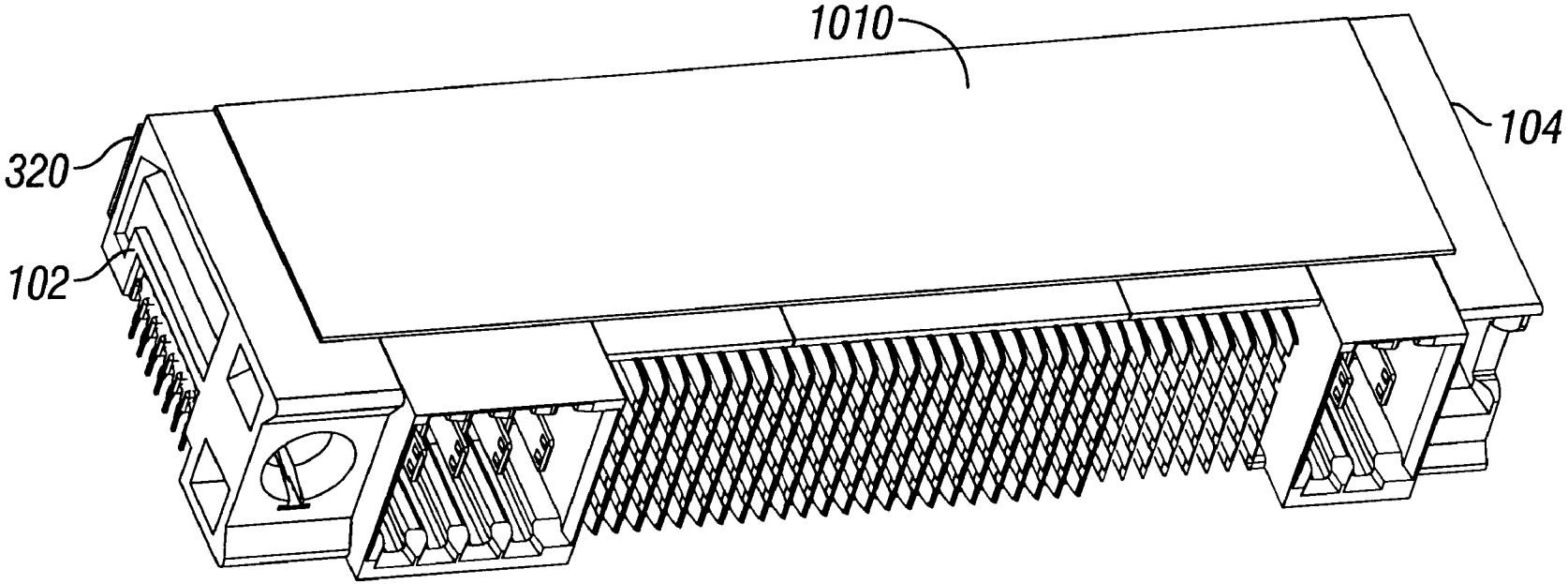
FIG. 10 illustrates a top front perspective view of a connector module pack joined with an adhesive medium in accordance with an embodiment of the present invention.
Figure 11:
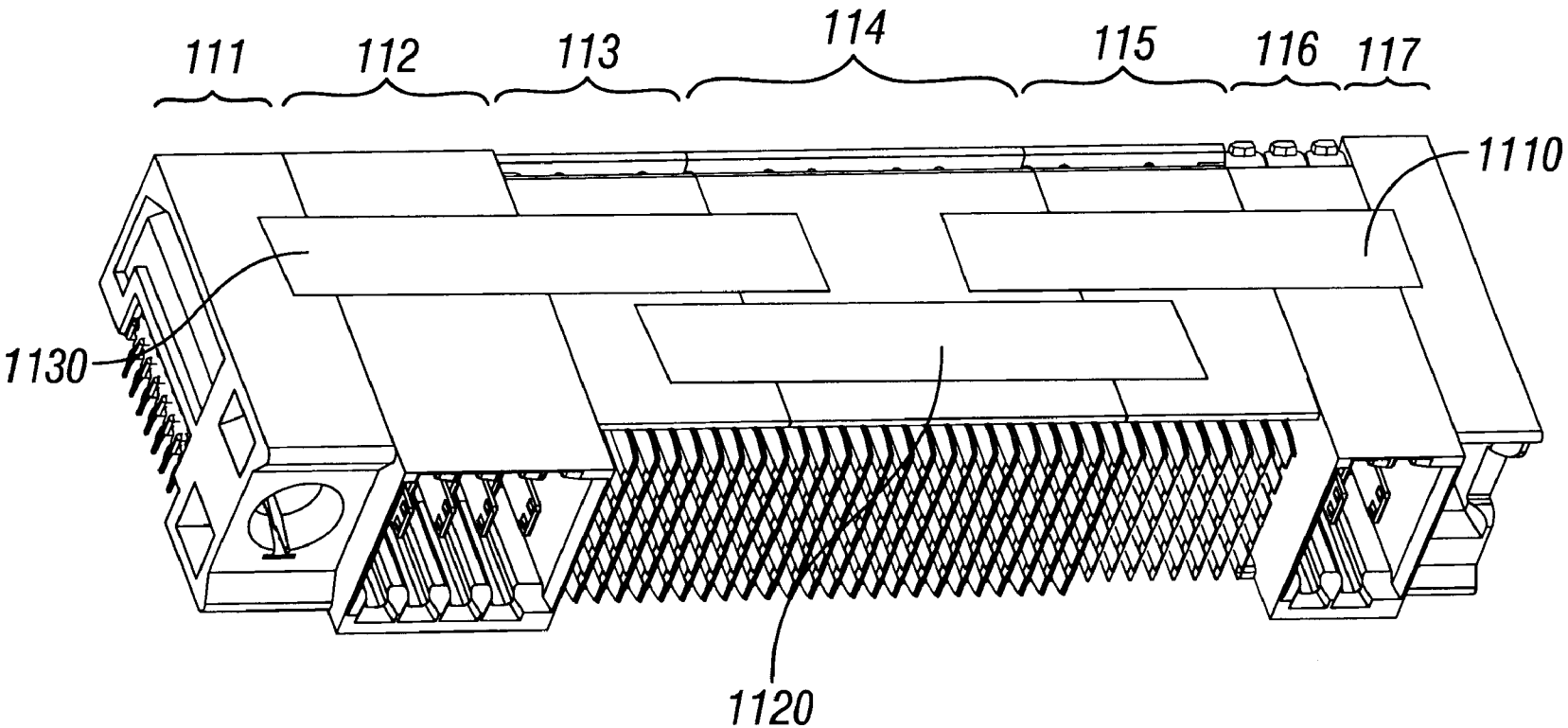
FIG. 11 illustrates a top front perspective view of a connector module pack joined with an adhesive medium in accordance with an embodiment of the present invention.

FIG. 10 illustrates the connector module pack 100 used in connection with an embodiment of the present invention. The connector module pack 100 includes an adhesive tape strip 1010 that does not run from the end 102 to the end 104.

FIG. 11 illustrates the connector module pack 100 used in connection with an embodiment of the present invention. The connector module pack 100 includes three adhesive tape strips 1110, 1120, 1130. None of the adhesive tape strips attaches to all of the connector modules 111–117 of the connector module pack 100. Tape strip 1110 attaches to connector modules 114–117. Tape strip 1120 attaches to connector modules 113–115. Tape strip 1130 attaches to connector modules 111–114.

Figure 12:
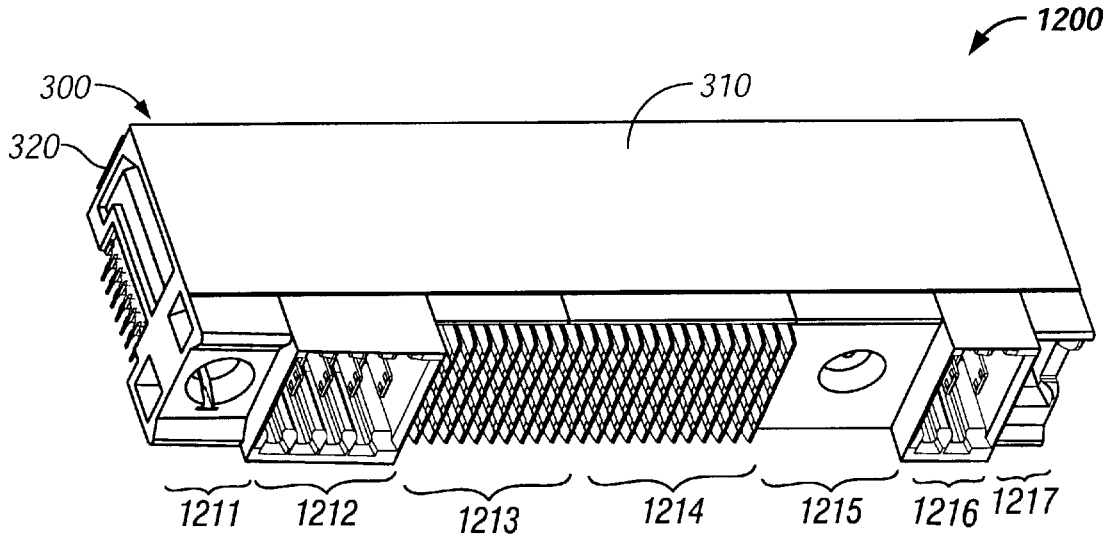
FIG. 12 illustrates a top front perspective view of a connector module pack joined with an adhesive medium in accordance with an embodiment of the present invention.

FIG. 12 illustrates a connector module pack 1200 joined with the adhesive medium 300 in accordance with an embodiment of the present invention. The connector module pack 1200 includes connector modules 1211–1217 of which one is a fiber optic connector module 1215.

Figure 13:
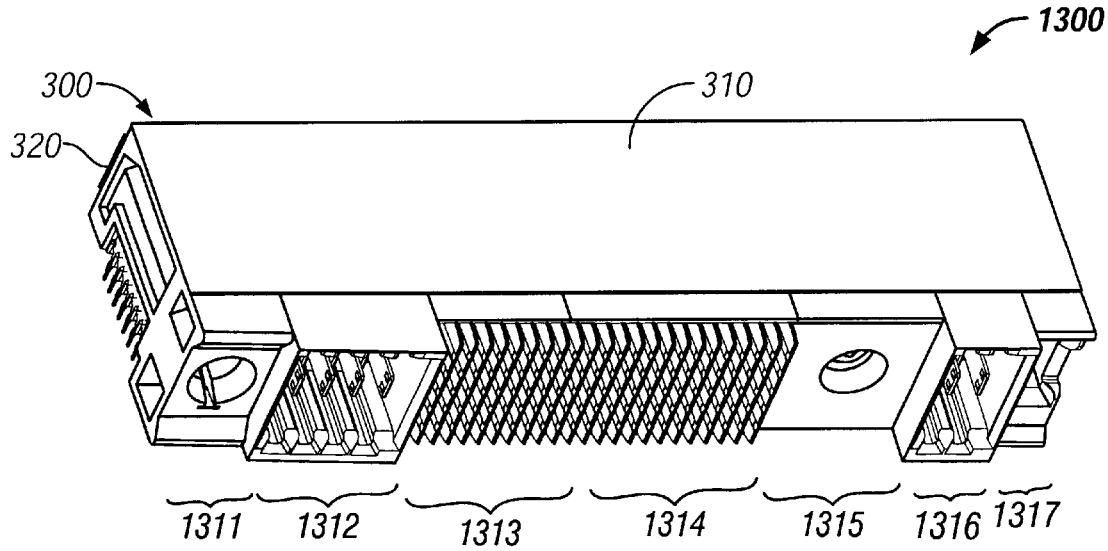
FIG. 13 illustrates a top front perspective view of a connector module pack joined with an adhesive medium in accordance with an embodiment of the present invention.

FIG. 13 illustrates a connector module pack 1300 joined with the adhesive medium 300 in accordance with an embodiment of the present invention. The connector module pack 1300 includes connector modules 1311–1317 of which one is an infrared connector module 1315.

Figure 14:
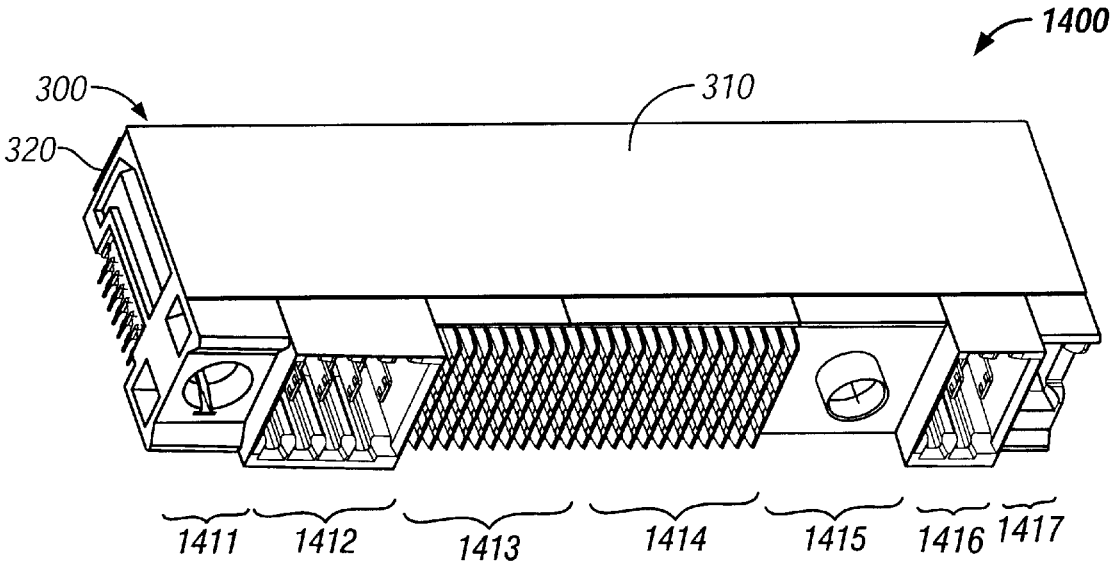
FIG. 14 illustrates a top front perspective view of a connector module pack joined with an adhesive medium in accordance with an embodiment of the present invention.

FIG. 14 illustrates a connector module pack 1400 joined with the adhesive medium 300 in accordance with an embodiment of the present invention. The connector module pack 1400 includes connector modules 1411–1417 of which one is a coaxial connector module 1415.

Figure 15:
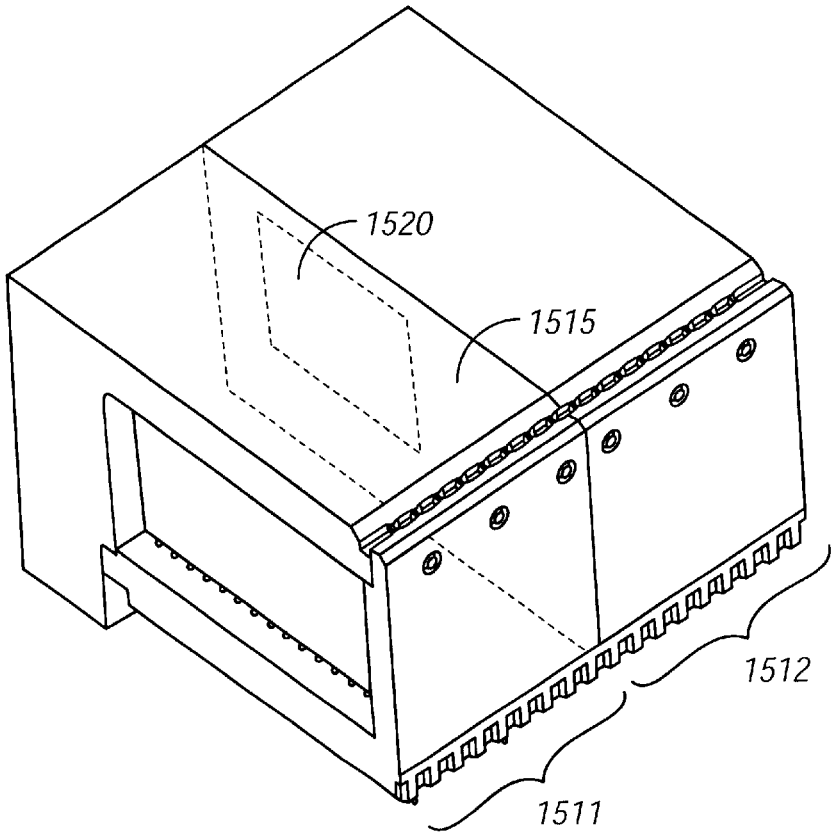
FIG. 15 illustrates a perspective view of two adjoined connector modules with an adhesive medium therebetween in accordance with an embodiment of the present invention.

FIG. 15 illustrates two adjoined connector modules 1511, 1512 in accordance with an embodiment of the invention. The connector modules 1511, 1512 include an interface 1515. The connector modules 1511, 1512 are arranged side by side in direct contact at the interface 1515. The interface 1515 includes a double-sided adhesive tape strip 1520. The adhesive tape strip 1520 holds the connector modules 1511, 1512 together at the interface 1515.

Figure 16:
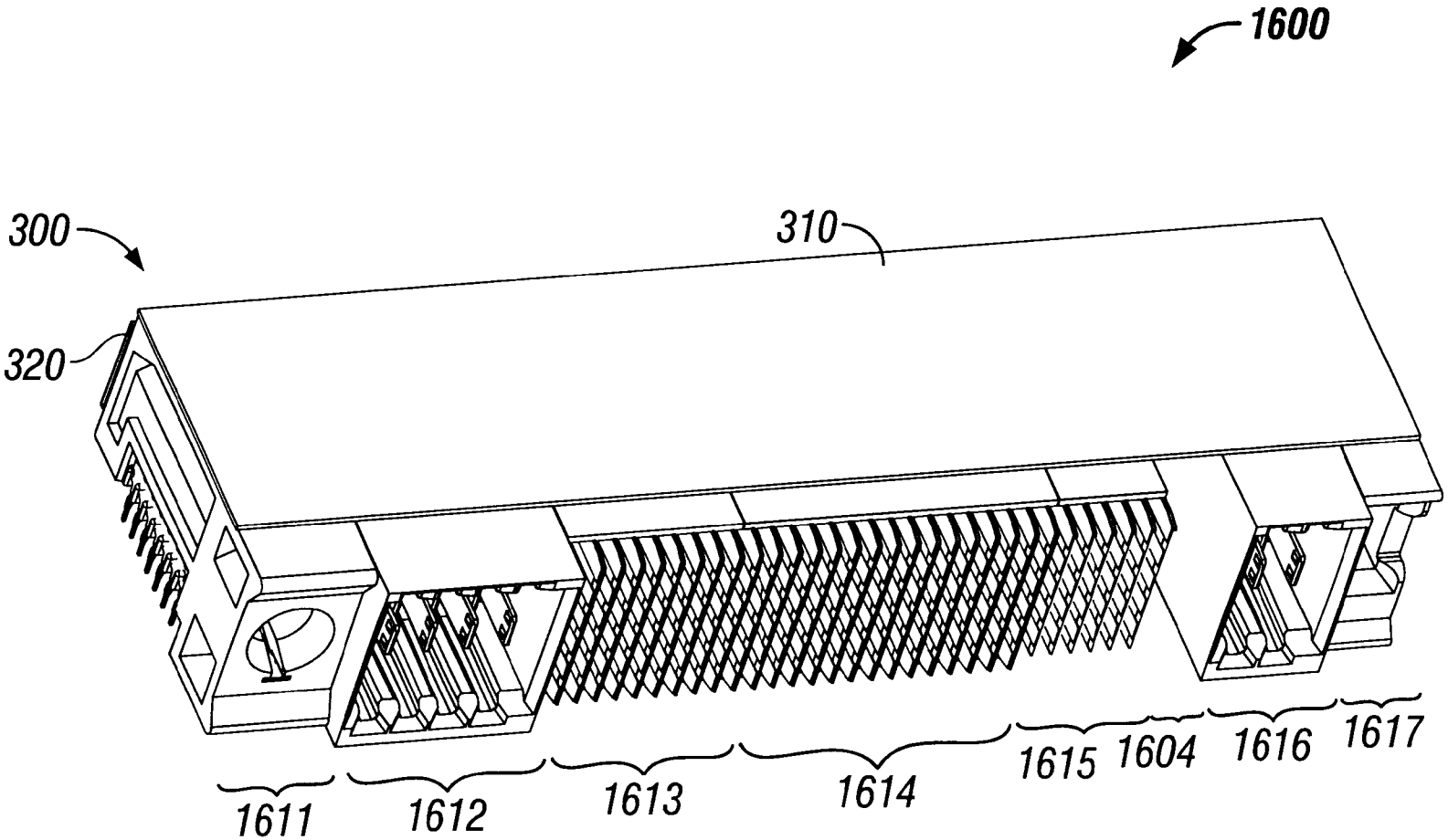
FIG. 16 illustrates a top front perspective view of a connector module pack joined with an adhesive medium in accordance with an embodiment of the present invention.

FIG. 16 illustrates a connector module pack 1600 joined with the adhesive medium 300 in accordance with an embodiment of the present invention. The connector module pack 1600 includes connector modules 1611–1617. The connector module pack 1600 includes a gap 1604 between two adjacent but not touching connector modules 1615, 1616. The gap 1604 may accommodate another component already on a printed circuit board to which the connector module pack 1600 will be attached. Alternatively, the gap 1604 may accommodate cooling during operation of the connector module pack 1600.

Figure 17:
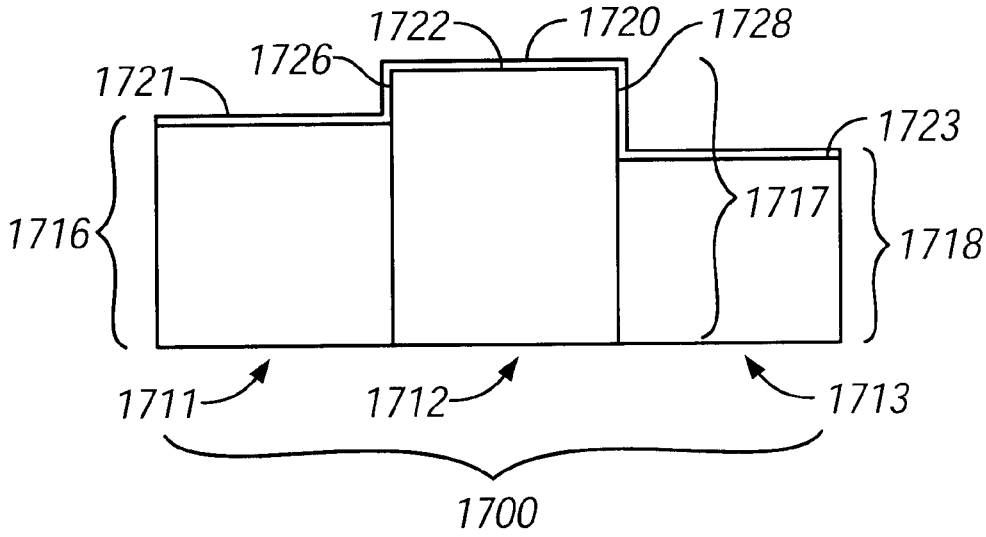
FIG. 17 illustrates a back perspective view of a connector module pack joined with an adhesive medium in accordance with an embodiment of the present invention.

FIG. 17 illustrates a connector module pack 1700 joined with an adhesive medium 1720 in accordance with an embodiment of the present invention. The connector module pack 1700 includes three connector modules 1711–1713 arranged side by side in direct contact with one other. The connector modules 1711–1713 include top surfaces 1721–1723, respectively. The connector modules 1711–1713 include heights 1716–1718, respectively. The heights 1716–1718 are different from one another. Because the heights 1716–1718 are different, none of the top surfaces 1721–1723 is aligned in a common plane with any other of the top surfaces 1721–1723. A middle connector module 1712 includes left and right side walls 1726, 1728. The adhesive medium 1720 is attached to top surface 1721 of connector module 1711, to the left side wall 1726 of the middle connector module 1712, to top surface 1722 of the middle connector module 1712, to the right side wall 1728 of the middle connector module 1712, and to top surface 1723 of connector module 1713.

Figure 18:
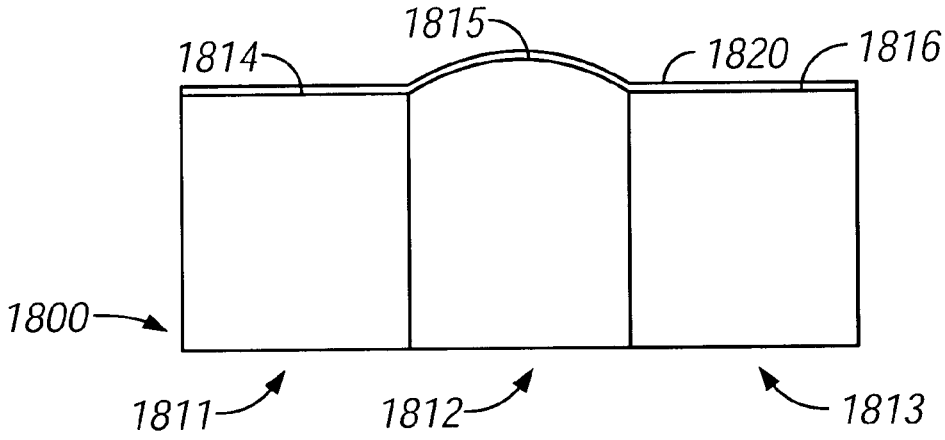
FIG. 18 illustrates a back perspective view of a connector module pack joined with an adhesive medium in accordance with an embodiment of the present invention.

FIG. 18 illustrates a connector module pack 1800 joined with an adhesive medium 1820 in accordance with an embodiment of the present invention. The connector module pack 1800 includes three connector modules 1811–1813 arranged side by side in direct contact with one other. The connector modules 1811–1813 include top surfaces 1814–1816, respectively. Top surfaces 1814, 1816 are planar. Top surface 1815 is not planar. The adhesive medium 1820 is attached to the top surfaces 1814–1816 of the connector modules 1811–1813.

While the embodiments referenced above employ guide connector modules, power connector modules, signal connector modules, fiber optic connector modules, infrared connector modules, and coaxial connector modules, the term connector modules is in no way limited to these six specific types.

Also, while the embodiments referenced above employ adhesive tape strips to retain the connector module packs, the term "adhesive medium" is in no way limited to adhesive tape strips. Furthermore, the term "adhesive medium" is not necessarily singular or plural. The term "adhesive medium" may refer to one adhesive medium or multiple adhesive mediums. Optionally, the adhesive medium may be applied to a single surface of each connector module.

While the embodiments referenced above employ the term, connector module, in reference to individual connector modules, the term, connector module, is not limited to individual connector modules such as the connector module 113. The term, connector module, also refers to connectors and connector module packs such as the connector module pack 100. For instance, in accordance with an embodiment of the present invention, the connector module pack 100 could be arranged next to the connector module pack 600 end to end, forming a larger connector module pack, and held together by an adhesive tape.

While the embodiments referenced above employ some walls of connector modules aligned in common planes, other embodiments may employ connector modules not having any walls aligned in common planes.

While certain embodiments have been described, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A method of organizing and retaining multiple connector modules in a predetermined arrangement, each connector module having multiple walls comprising:

organizing multiple connector modules into a module pack such that said connector modules are positioned in a predetermined order with respect to one another;

aligning at least two connector modules adjacent one another, each of said at least two connector modules having a height, width and depth, said at least two connector modules having at least one of different heights, different widths and different depths joining at a non-planar interface; and applying an adhesive medium to at least one wall of each of said connector modules in said module pack, said adhesive medium holding said connector modules in said module pack in said predetermined order, said adhesive medium spanning across said non-planar interface.

2. The method of claim 1, further comprising attaching at least one adhesive medium to a surface of at least one of top, side, and back walls of said connector modules.

3. The method of claim 1, further comprising attaching said adhesive medium to surfaces of walls of said connector modules proximate to one another to secure and retain said connector modules in a predefined orientation and alignment with respect to one another.

4. A method of organizing and retaining multiple electrical connector modules in a predetermined arrangement for installation on a circuit board, comprising:

organizing multiple electrical connector modules in a module pack such that said connector modules are positioned in a predetermined order with respect to one another, said organizing step includes aligning a first wall of a first connector module and a first wall of a second connector module in a first common plane and aligning a second wall of said first connector module and a second wall of said second connector module in a second common plane; and applying at least one adhesive tape strip to at least one of top, bottom, and back surfaces of said connector modules, said at least one adhesive tape strip holding said connector modules in said module pack in said predetermined order said at least one adhesive tape strip holding said first and second connector modules in corresponding said first and second common planes.

5. The method of claim 4, further comprising aligning at least said first and second connector modules side by side with adjacent side surfaces abutting against one another.

6. The method of claim 4, further comprising aligning at least said first and second connector modules proximate one another while maintaining a gap between adjacent side surfaces, said gap having a predetermined width spanned by said at least one adhesive tape strip.

7. The method of claim 4, further comprising first and second adhesive tape strips adhering to said first and second walls, respectively, to hold said first and second connector modules in said first and second common planes.

8. The method of claim 4, further comprising attaching adhesive tape strips to at least two of said top, bottom, and back surfaces on each of said first and second connector modules.

9. The method of claim 4, wherein said organizing step includes mounting said first and second connector modules on a template, said template retaining said first and second connector modules positioned in said predetermined order with respect to one another.

10. An electrical connector module pack, comprising:

first and second connector modules having top, bottom, back and side walls and having mating faces, each of said mating faces being configured to receive one of power contacts, signal contacts, and a guide;

said first and second connector modules being organized in a module pack in a predetermined order with respect to one another such that said side walls of said first and second connector modules are located adjacent one another, wherein said first and second connector modules have one of said top, bottom and back walls aligned in a first common plane and another of said top, bottom and back walls aligned in a second common plane; and an adhesive tape strip secured to at least one of said top, bottom and back walls on said first and second connector modules to hold said first and second connector modules in said predetermined order and in corresponding said first and second common planes.

11. The connector module pack of claim 10, wherein said adhesive tape strip is applied to at least two of said top, bottom and back walls of each of said first and second connector modules.

12. The connector module pack of claim 10, wherein at least one of said top, bottom and back walls includes a curved surface, said adhesive tape strip adhering to said curved surface.

13. The connect or module pack of claim 10, wherein said adhesive tape strip includes multiple separate tape strips secured to tope and back walls of said connector modules.

14. The connector module pack of claim 10, wherein said adhesive tape strip constitutes metalized tape that is conductive and configured to be electrically connected to ground to afford electromagnetic shielding.

15. The connector module pack of claim 10, wherein said module pack is connected to a coaxial connector.

16. The connector module pack of claim 10, wherein said module pack is connected to a fiber optic connector.

17. The connector module pack of claim 10, wherein said module pack is connected to an infrared connector.

18. A connector module pack connected to a circuit board, said connector module pack comprising:

multiple connector modules having exterior walls and mating faces, said exterior walls configured to receive adjoining connector modules, and each of said mating faces configured to receive one of power contacts, signal contacts, and a guide pin;

said connector modules being organized in a module pack in a predetermined order with respect to one another, said connector modules each having first exterior walls aligned in a first common plane and each having second exterior walls aligned in a second common plane; and an adhesive tape strip applied to at least one of said first and second exterior walls of each of said connector modules to hold said connector modules in said predetermined order, said adhesive tape strip holding said first and second exterior walls aligned in said first and second common planes.

19. The connector module pack of claim 18, wherein said adhesive tape strip is applied to at least two exterior walls of each connector module.

20. The connector module pack of claim 18, wherein said adhesive tape strip constitutes a single continuous tape strip extending across said multiple connector modules.

21. The connector module pack of claim 18, wherein said adhesive tape strip includes separate top and back tape strips secured to top and back walls, respectively, of said multiple connector modules.

22. The connector module pack of claim 18, wherein said adhesive tape strip includes first and second adhesive strips, said first adhesive strip adhering to and holding together said first exterior wall of said first connector module and said first exterior wall of said second connector module in said first common plane, said second adhesive strip adhering to and holding together said first exterior wall of said second connector module and a first exterior wall of a third connector module in said first common plane.

23. The connector module pack of claim 18, wherein said adhesive tape strip includes multiple tape strips aligned in a staggered pattern upon first exterior walls of a group of connector modules arranged in said first common plane.

24. The connector module pack of claim 18, wherein said adhesive tape strip includes multiple tape strips aligned adjacent one another, at least first and second tape strips partially overlapping a common connector module.

* * * * *